US007988521B2

(12) United States Patent
Lai

(10) Patent No.: US 7,988,521 B2
(45) Date of Patent: Aug. 2, 2011

(54) SIMULATED EYE FOR TOY

(75) Inventor: Jin-Shi Lai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 125 days.

(21) Appl. No.: 12/539,567

(22) Filed: Aug. 11, 2009

(65) Prior Publication Data

US 2010/0048091 A1 Feb. 25, 2010

(30) Foreign Application Priority Data

Aug. 20, 2008 (CN) ..... 2008 1 0304096

(51) Int. Cl.
*A63H 3/38* (2006.01)
*A63H 3/48* (2006.01)

(52) U.S. Cl. ..... 446/301; 446/343; 446/392

(58) Field of Classification Search ..... 446/300, 446/301, 339–350, 391–393; 623/4.1, 6.63, 623/6.64

See application file for complete search history.

(56) References Cited

U.S. PATENT DOCUMENTS

| | | | | | |
|---|---|---|---|---|---|
| 3,353,296 | A * | 11/1967 | Ryan al. | 446/344 |
| 4,721,437 | A * | 1/1988 | Mitamura et al. | 379/388.02 |
| 4,843,497 | A * | 6/1989 | Leyden | 360/79 |
| 5,407,376 | A * | 4/1995 | Avital et al. | 446/175 |
| 5,769,687 | A * | 6/1998 | Ko | 446/343 |
| 6,238,262 | B1 * | 5/2001 | Pracas | 446/301 |
| 6,386,942 | B1 * | 5/2002 | Tang | 446/301 |
| 6,497,607 | B1 * | 12/2002 | Hampton et al. | 446/301 |
| 6,758,717 | B1 * | 7/2004 | Park et al. | 446/391 |
| 6,991,511 | B2 * | 1/2006 | Maggiore et al. | 446/330 |

* cited by examiner

*Primary Examiner* — Kien T Nguyen
(74) *Attorney, Agent, or Firm* — Zhigang Ma

(57) ABSTRACT

A simulated eye is capable of being rotatable along a circular track. The simulated eye includes an eyeball, a motor having a motor shaft, and a transmission assembly. The transmission assembly is fixed to the motor shaft and is driven to rotate around the motor shaft by the motor. The eyeball is fixed to the transmission assembly at a position departing from the axis of the motor shaft, and is driven to rotate around the motor shaft.

12 Claims, 5 Drawing Sheets

SIMULATED EYE FOR TOY

BACKGROUND

1. Technical Field

The disclosure relates to toys and, more particularly, to a simulated eye for a toy.

2. Description of Related Art

As the development of the electronic technology, more and more robot toys simulate people's actions, such as, walking, jumping, and so on. As known, eyes are one of the most important organs of human body, and people can express various feelings via the actions of the eyes. The eyes of some robot toys simulate human eyes by imitating various shapes of the human eyes. However, some of these simulations are limited to the eyelids opening and closing, and accordingly, other simulation effects of the eyes of the robot toys are needed to make the robot looks more lifelike. Therefore, what is needed is a simulated eye capable of simulating human eyes' actions.

BRIEF DESCRIPTION OF THE DRAWINGS

The components of the drawings are not necessarily drawn to scale, the emphasis instead being placed upon clearly illustrating the principles of the embodiments of a simulated eye. Moreover, in the drawings, like reference numerals designate corresponding parts throughout several views.

DETAILED DESCRIPTION

Figure 1:
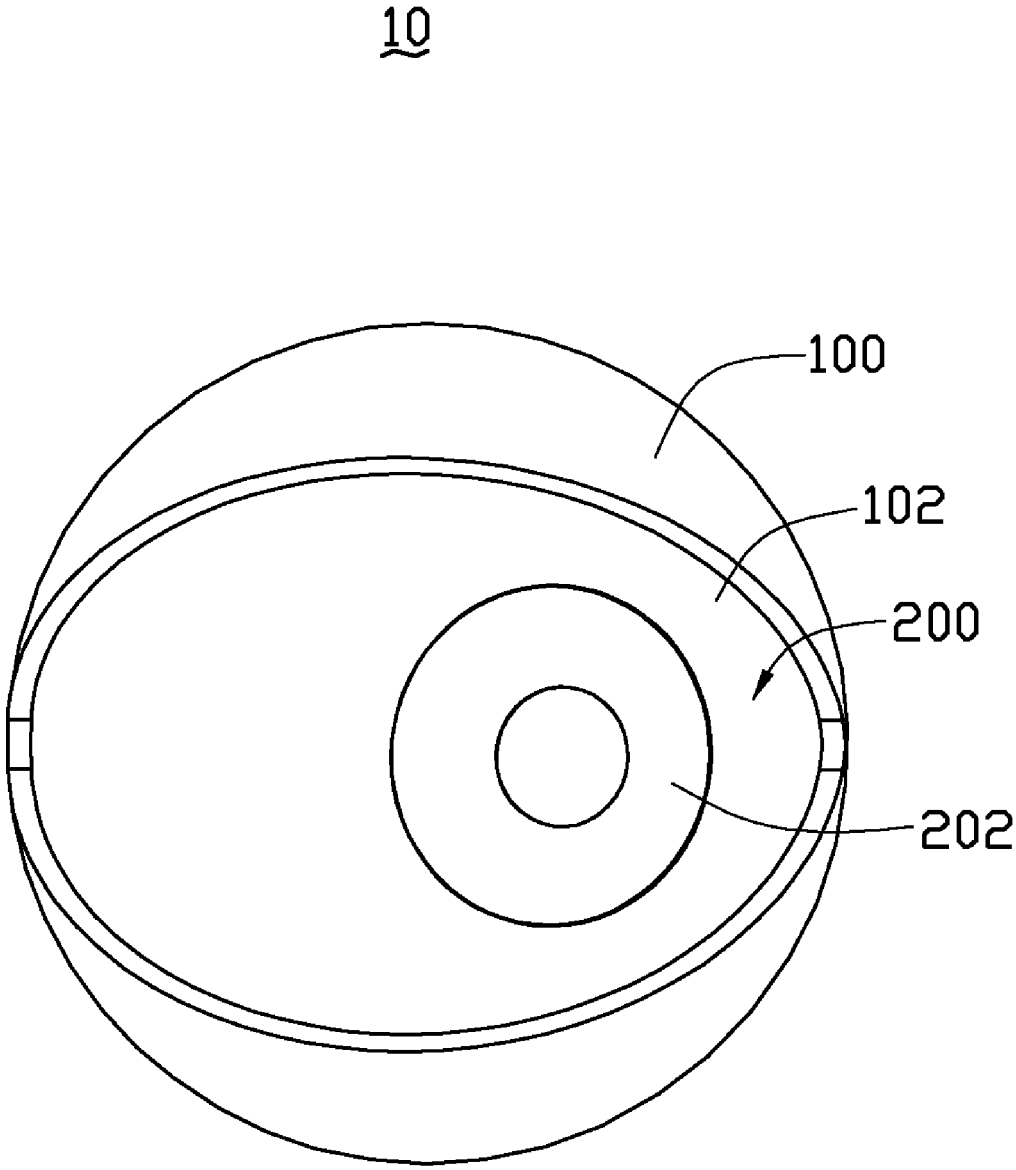
FIG. 1 is a perspective view of a simulated eye having an eyeball in accordance with one embodiment.

Referring to FIG. 1, a simulated eye 10 includes a hollow spherical housing 100, an eyeball 200 having an iris 202. The housing 100 is configured to receive the eyeball 200. An opening 102 is defined in the housing 100. The eyeball 200 is exposed at the opening 102 so as to simulate an open state of human eyes.

Figure 2:
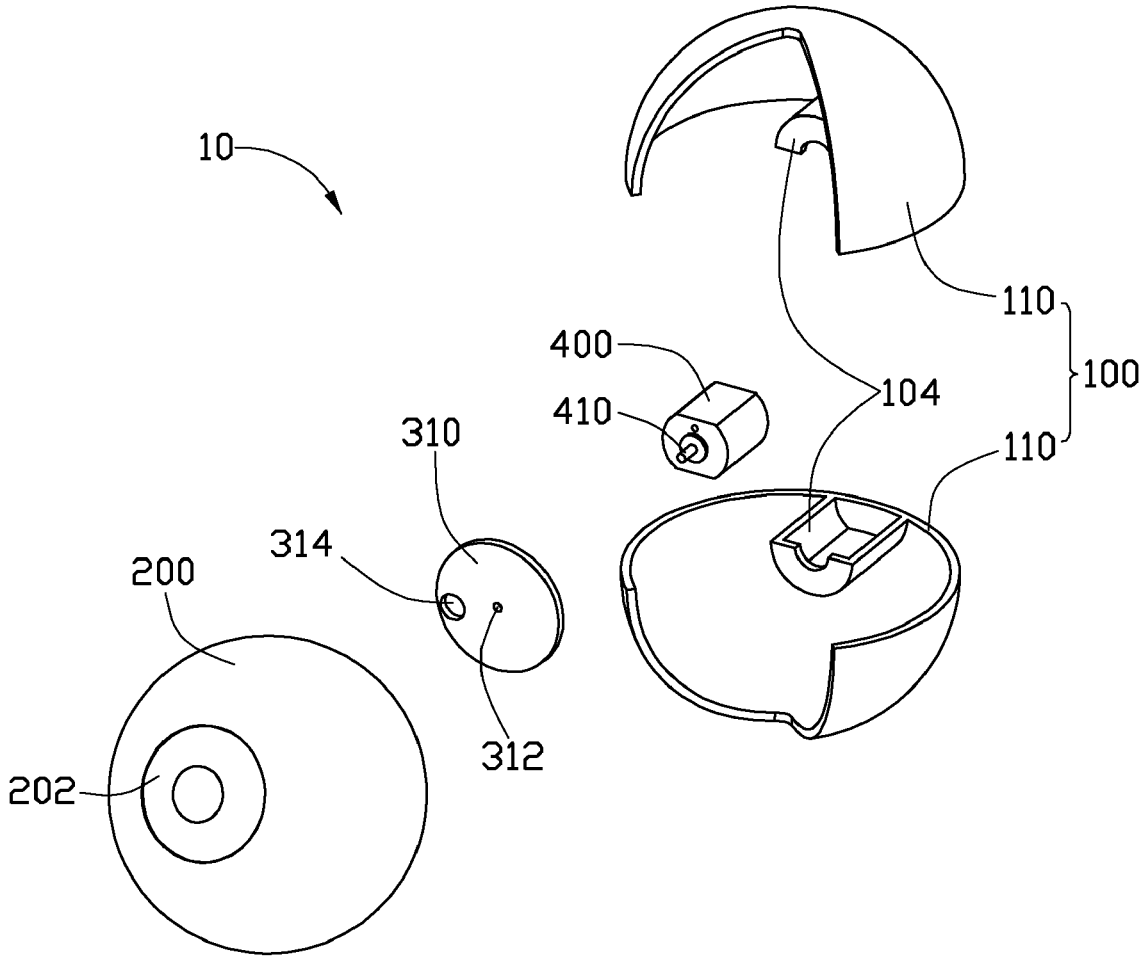
FIG. 2 is an exploded view of the simulated eye of FIG. 1.
Figure 3:
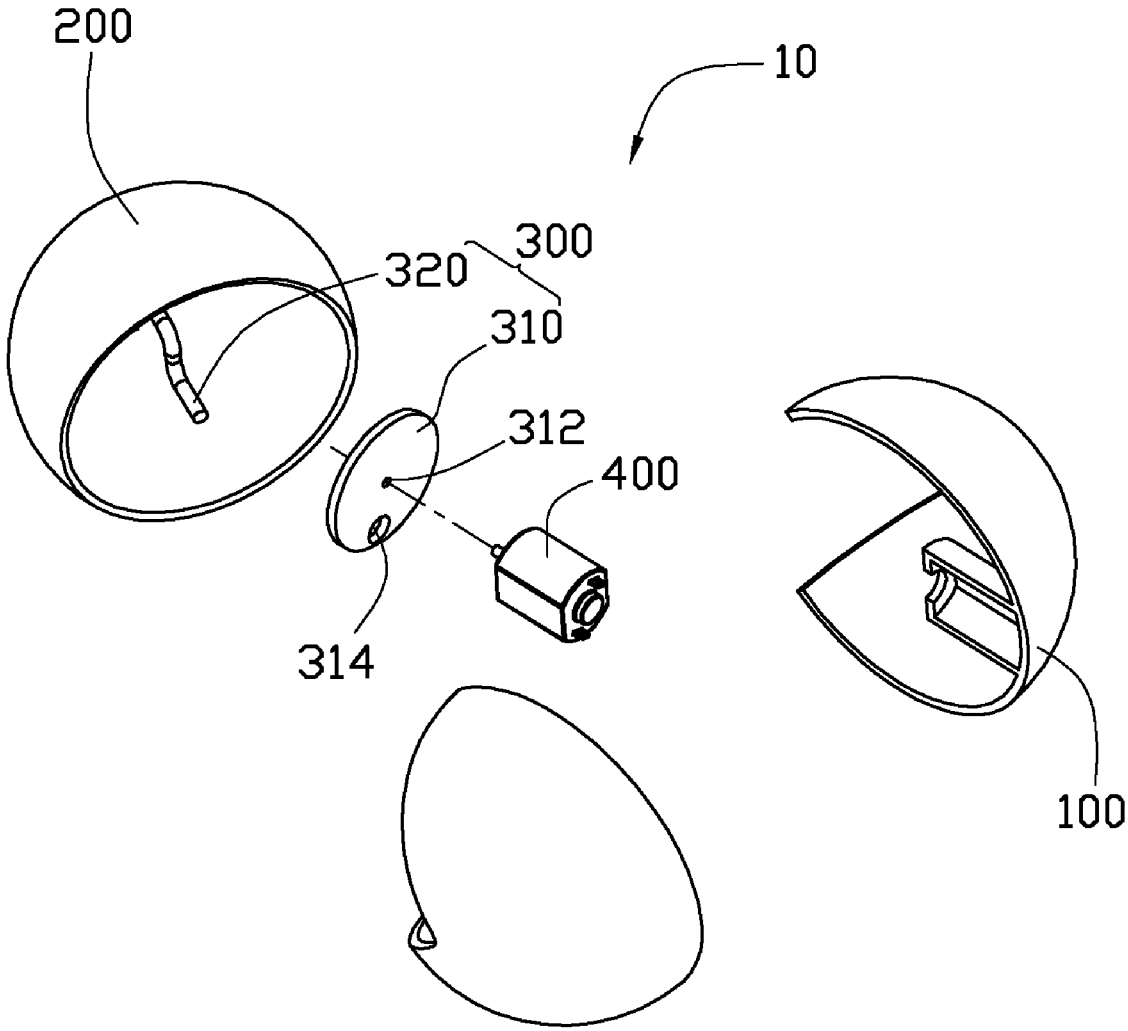
FIG. 3 is also an exploded view similar to FIG. 2, but viewed from another aspect.
Figure 4:
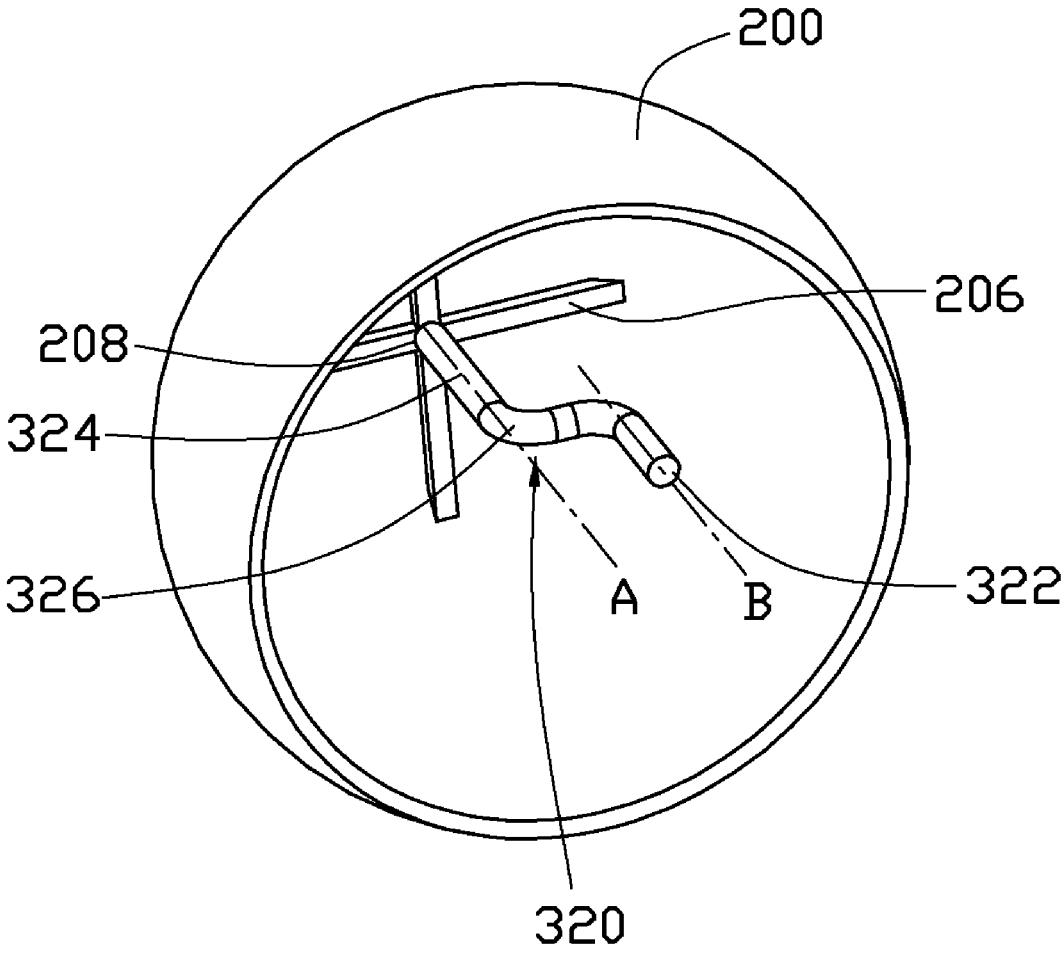
FIG. 4 is a perspective view of the eyeball of FIG. 1 having a cross hub.

Referring to FIGS. 2 to 4, the simulated eye 10 further includes a transmission assembly 300 and a motor 400. The motor 400 has a motor shaft 410. The eyeball 200 is coupled to the motor shaft 410 via the transmission assembly 300. As a result, the eyeball 200 is driven to rotate with the motor shaft 410 by the motor 400.

The transmission assembly 300 includes a circular transmission plate 310 and a substantially Z-shaped transmission shaft 320. A shaft hole 312 is defined in the center of the transmission plate 310, and a through hole 314 is defined near the rim of the transmission plate 310. The transmission shaft 320 includes a first rod 322 and a second rod 324. A connection member 326 joins the first rod 322 to the second rod 324, and an axis of the first rod 322 is parallel to that of the second rod 324. The motor shaft 410 is fixed in the shaft hole 312, and the first rod 322 is fixed in the through hole 314. The second rod 324 is fixed at an inner surface of the eyeball 200. Therefore, the eyeball 200 is coupled to the motor 400 via the transmission assembly 300. In the embodiment, referring to FIG. 4, a cross hub 206 is mounted in the inner surface of the eyeball 200, and the second rod 324 is coupled to the intersecting center 208 of the cross hub 206.

The housing 100 includes two symmetrical portions 110. A holding member 104 is formed after the two symmetrical portions 100 are assembled together, and the holding member 104 is configured to hold the motor 400.

Figure 5:
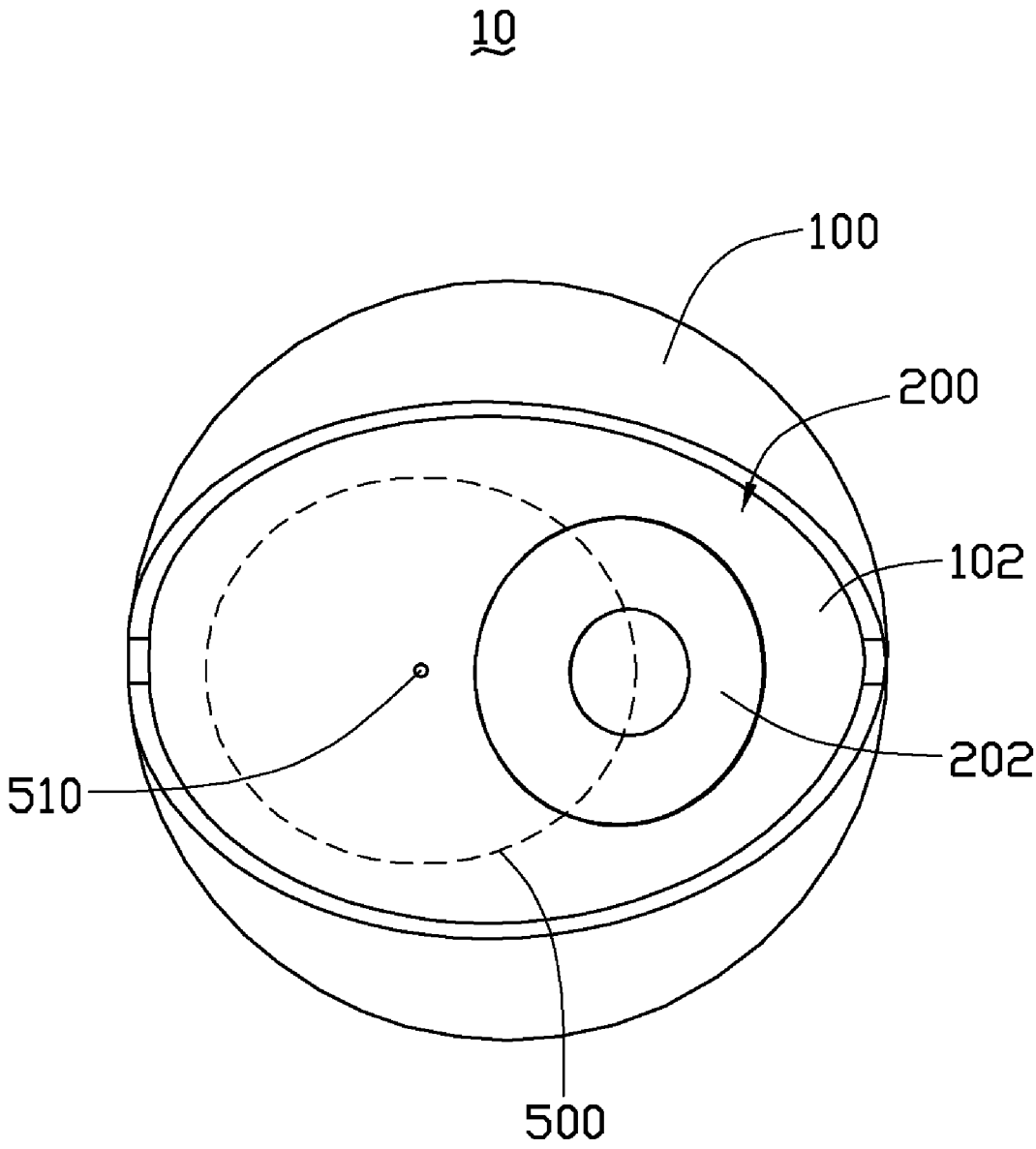
FIG. 5 is perspective view of the simulated eye of FIG. 1 in a rotated state.

Referring to FIGS. 4 and 5, after assembly, the intersecting center 208 locates on a side of the eyeball 200 opposite to a center of the iris 202. The center of the iris 202, the joint 208, and the second rob 324 are aligned on a first straight line A. The first rod 322 and a center of the through hole 314 are aligned on a second straight line B. The first straight line A and the second straight line B are parallel to an axis of the motor shaft 410 extending through a center of the shaft hole 312. When the transmission assembly 300 is driven by the motor 400, the transmission plate 310 rotates around the motor shaft 410. As a result the eyeball 200 fixed to the second rob 324 rotates around the axis of the motor shaft 410. Furthermore, the iris 202 is driven to move along a circular track 500 with a center 510. The center 510 is aligned along the axis of the motor shaft 410, and the radius of the track 500 substantially equals to a displacement between the straight line A and the axis of motor shaft 410.

In another embodiment, the first rod 322 is directly fixed in the shaft hole 312. The first rod 322 and the center of the shaft hole 312 are aligned on the axis of the motor shaft 410. Accordingly, the eyeball 200 is directly driven to rotate around the shaft motor 410.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

an eyeball;

a motor comprising a motor shaft; and a transmission assembly;

wherein the transmission assembly is fixed to the motor shaft and is driven to rotate with the motor shaft by the motor, the eyeball is fixed to the transmission assembly at a position departing from the axis of the motor shaft, and is driven to rotate around the motor shaft.

2. The simulated eye as described in claim 1, further comprising a housing defining an opening, the eyeball is housed in the housing and exposed via the opening.

3. The simulated eye as described in claim 2, wherein the housing further comprises a holding member for holding the motor.

4. The simulated eye as described in claim 1, wherein the transmission assembly comprises a transmission plate, and a transmission shaft; a shaft hole is defined in the transmission plate, a through hole is defined in the transmission plate departing from the shaft hole of the transmission plate, the eyeball is coupled to the transmission plate via the transmission shaft at the through hole, and the motor shaft is coupled to the transmission plate at the shaft hole.

5. The simulated eye as described in claim 4, wherein the transmission shaft is substantially Z-shaped, the transmission shaft comprises a first rod, a second rod, a connection member connecting the first rod to the second rod; the first rod is fixed to the transmission plate at the through hole, and the second rod is fixed to the eyeball.

6. The simulated eye as described in claim 5, wherein the eyeball comprises a iris, and the second rod is fixed to the eyeball at a position opposite to the center of the iris; the center of the iris and the second rob are aligned on a first straight line.

7. The simulated eye as described in claim 6, wherein the through hole and the second rod are aligned on a second straight line, both the first straight line and the second straight line are parallel to an axis of the motor shaft extending through the shaft hole.

8. The simulated eye as described in claim 5, wherein the eyeball further comprises a cross hub, the cross hub is fixed in an inner surface of the eyeball, the second rod is fixed at the center of cross hub opposite to the center of the iris.

9. A simulated eye, comprising:

an eyeball;

a housing for receiving the eyeball;

a motor having a motor shaft; and a transmission assembly for connecting the eyeball to the motor;

wherein the eyeball is driven by the transmission assembly in response to an action transmitted from the motor to rotate along a circular track, the motor shaft substantially extends through a center of the circular track.

10. The simulated eye as described in claim 9, wherein the eyeball comprises an iris, the iris is coupled to the motor via the transmission assembly, and is driven to rotate along the circular track.

11. The simulated eye as described in claim 9, wherein the transmission assembly comprises a transmission plate, and a transmission shaft; a shaft hole is defined in the transmission plate, a through hole is defined in the transmission plate departing from the shaft hole of the transmission plate, the eyeball is coupled to the transmission plate via the transmission shaft at the through hole, and the motor shaft is coupled to the transmission plate at the shaft hole.

12. The simulated eye as described in claim 11, wherein the transmission shaft is substantially Z-shaped, the transmission shaft comprises a first rod, a second rod, a connection member for connecting the first rod to the second rod; the first rod is fixed to the transmission plate at the through hole, and the second rod is fixed to the eyeball.

* * * * *